United States Patent [19]

Keesee et al.

[11] Patent Number: 4,537,328

[45] Date of Patent: Aug. 27, 1985

[54] STORAGE TANK

[75] Inventors: Kenneth M. Keesee, Anaheim; John R. Guyer, Riverside, both of Calif.

[73] Assignee: Keesee Tank and Pump Co., Inc., Anaheim, Calif.

[21] Appl. No.: 609,612

[22] Filed: May 14, 1984

[51] Int. Cl.[3] ..... B65D 87/24

[52] U.S. Cl. ..... 220/445; 220/420

[58] Field of Search ..... 220/445, 448, 466, 469, 220/420, 1 B, 85 S, 465

[56] References Cited

U.S. PATENT DOCUMENTS

| | | | |
|---|---|---|---|
| 1,927,255 | 9/1933 | Brown | 220/420 |
| 2,268,517 | 12/1941 | Small | 220/445 X |
| 2,767,962 | 10/1956 | Blackburn | 220/420 X |
| 2,907,177 | 10/1959 | Daley et al. | 220/420 X |

*Primary Examiner*—Steven M. Pollard

*Attorney, Agent, or Firm*—Harvey C. Nienow

[57] ABSTRACT

A storage tank, principally for fluids, having an inner primary tank formed of steel, and having a plastic coating, and an outer tank formed of sheet material composed of glass fibers and plastic resin, and having a coating of glass fibers and resin applied to the exterior thereof. Elongated spacers formed of plastic material and having a generally semi-circular, arcuate cross-section are positioned between the cylindrical wall of the primary and outer tanks as well as between the corresponding endwalls thereof. The elongated arcuate spacers beneath the primary tank are in closer spaced relation to each other than are the elongated arcuate spacers above the primary tank. A plastic elongated probe member is positioned between the adjacent endwalls of the primary and outer tanks to be positioned vertically when the storage tank is properly mounted in a horizontal position, to enable tests to be made within such probe member of fluid material which may accumulate between the primary and outer tanks.

7 Claims, 7 Drawing Figures

STORAGE TANK

The present invention relates generally to storage tanks, but more particularly to tanks which can be prevented from losing or dispersing their contents to the surrounding environment, upon the occurrence of a rupture or break in the tank.

BACKGROUND OF THE INVENTION

Within the past several decades, there has developed greater awareness of possible damage to the environment from various different occurrences. It has been realized that with all of the many toxic and otherwise obnoxious fluids which are used in industry as well as in other aspects of our society, even minor problems wherein such harmful fluids are allowed to seep into the surrounding environment, create calamitous conditions. Not only is the normal or natural flora and fauna affected directly by these harsh chemicals polluting the environment, but even human beings are caused to contract very harmful and debilitating diseases, many of which result in death.

As a result of such polluting of the environment, it has become apparent that containers which house such harmful ingredients must be virtually deterioration-proof such that if and when something happens to such container, the contents thereof is prevented from leaking into the surrounding environment. This is particularly true with respect to containers such as tanks which are buried below ground level where they are completely concealed and out of view, such as tanks which are used for the storage of gasoline, oil and similar fluid materials.

SUMMARY OF THE INVENTION

To alleviate the foregoing problems, applicant has devised a tank which is formed with a primary, inner tank, as well as an outer tank which surrounds the primary tank. The primary tank is formed of steel coated with plastic resin, and the outer tank is formed of glass fibers immersed in plastic resin, to thereby provide a storage tank which is virtually unaffected by outside chemicals.

It is an object of the present invention to provide a storage tank which comprises a primary inner tank, and an outer tank thereabout.

Another object of the present invention is to provide a storage tank as characterized above wherein spacers are employed for positioning the outer tank in a predetermined spaced relation to the inner primary tank.

A still further object of the present invention is to provide a storage tank as characterized above wherein such spacers are elongated plastic members having a generally semi-circular arcuate cross-section.

Another still further object of the present invention is to provide a storage tank as characterized above wherein one or more probe members is provided in the space between the primary and outer tanks to enable testing to be performed of the accumulation of liquids or other fluids between such tanks.

An even still further object of the present invention is to provide a storage tank as characterized above wherein suitable access openings and fittings are provided for ingress and egress of fluids within the inner primary tank.

Another even still further object of the present invention is to provide a storage tank as characterized above which is rugged and dependable in use, and which is relatively inexpensive to manufacture.

BRIEF DESCRIPTION OF THE DRAWINGS

The novel features which I consider characteristic of my invention are set forth with particularity in the appended claims. The invention, itself, however, both as to its organization and mode of operation, together with additional objects and advantages thereof, will best be understood from the following description of specific embodiments when read in connection with the accompanying drawings, in which:

DESCRIPTION OF THE PREFERRED EMBODIMENT

Figure 1:
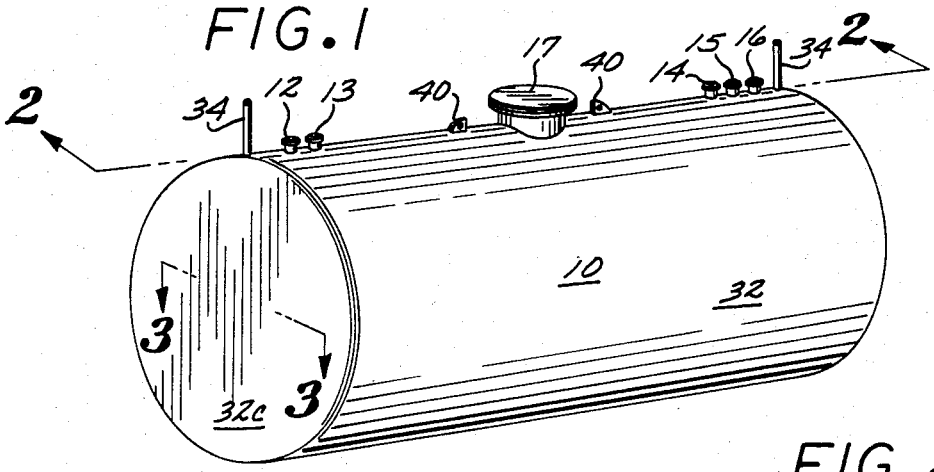
FIG. 1 is a perspective view of a storage tank according to the present invention.

Like reference characters indicate corresponding parts throughout the several views of the drawings.

Referring to FIG. 1 of the drawings, there is shown therein a storage tank 10 according to the present invention. Such storage tank is provided with access fittings 12, 13, 14, 15, 16 and 17, which, as will hereinafter be explained in greater detail, afford access to the interior of storage tank 10.

Figure 2:
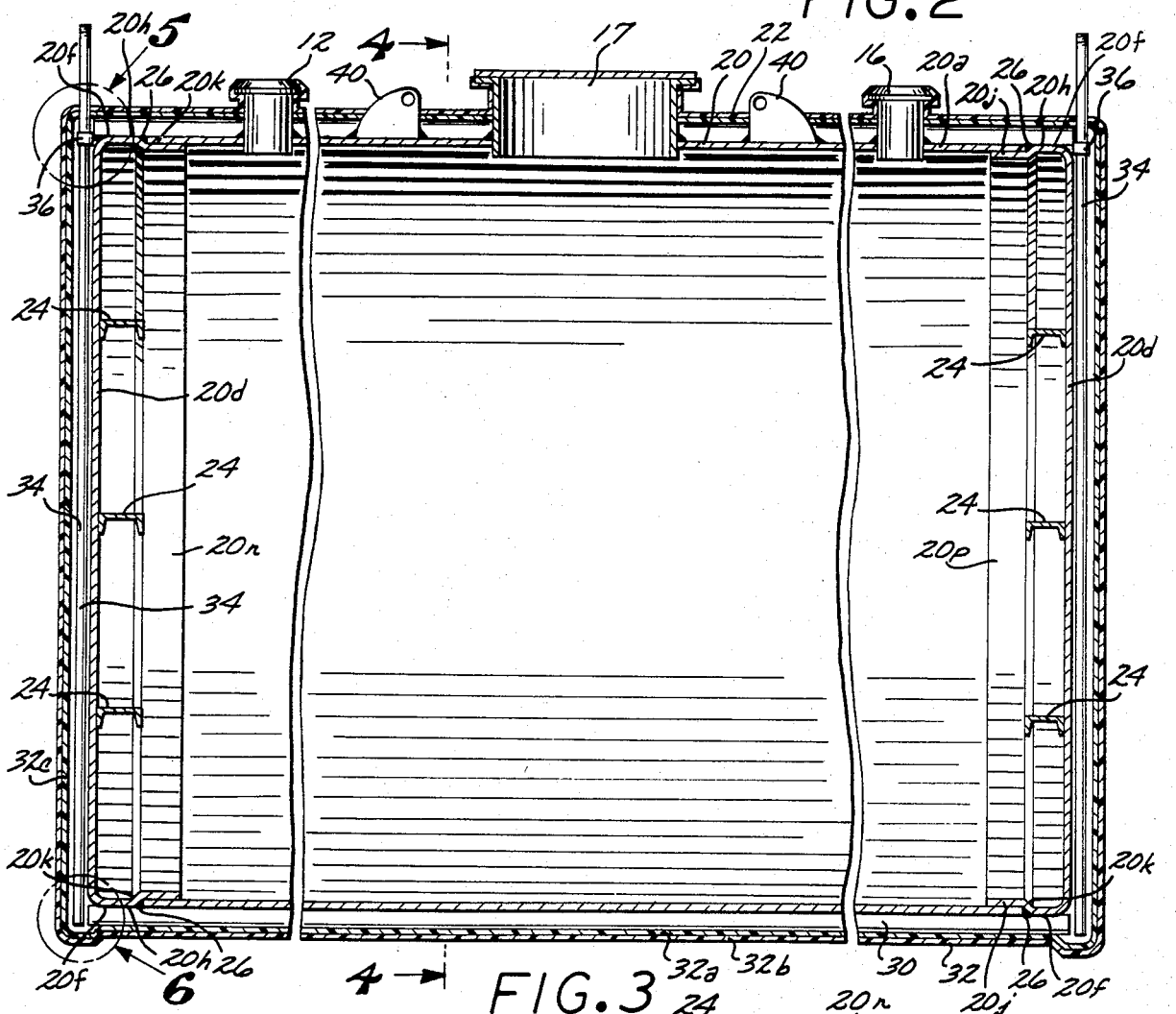
FIG. 2 is a fragmentary sectional view taken substantially along line 2—2 of FIG. 1 of the drawings.

Referring to FIG. 2 of the drawings, storage tank 10 is formed with a primary, inner tank 20, and an outer tank 22. Primary tank 20 is formed of sheet steel or other appropriate material and comprises a generally tubular main body 20*a* to which are welded end structures 20*b* and 20*c*. As shown in detail with respect to end structure 20*b*, each end structure is formed with an endwall member, as shown at 20*d* and 20*e*, respectively, which member is generally circular in construction and has a marginal edge as shown at 20*f* and 20*g*, respectively, which is bent at substantially right angles to the respective endwall. This construction forms a generally cylindrical or tubular portion 20*h* and 20*j*, respectively, which is offset as at 20*k* and 20*l*, respectively, to provide an insert portion 20*n* and 20*p*, respectively, which fits within the corresponding end of main body 20*a*. Following insertion of the insert portion of the respective structures within the main body 20*a*, a welding bead 26 is provided about the periphery of the primary tank 20 at each end thereof to hermetically seal the end structures 20*b* and 20*c* within the main body 20*a*. To effectively reinforce each of the endwalls 20*d* and 20*e* so that they can withstand the fluid pressures caused by the primary tank 20 being filled with fluid, suitable steel U-shaped members 24 are welded across the inner surface of each such endwalls 20*d* and 20*e*.

The steel primary tank 20 is coated with a clear resin, as shown at 28, such coating being applied to the exterior of the main body 20*a*, as well as to the exterior of the endwall structures 20*b* and 20*c*.

Figure 3:
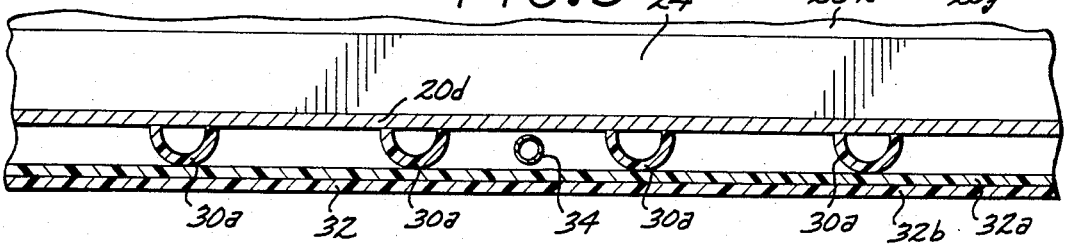
FIG. 3 is a fragmentary sectional view taken substantially along line 3—3 of FIG. 1 of the drawings.
Figure 4:
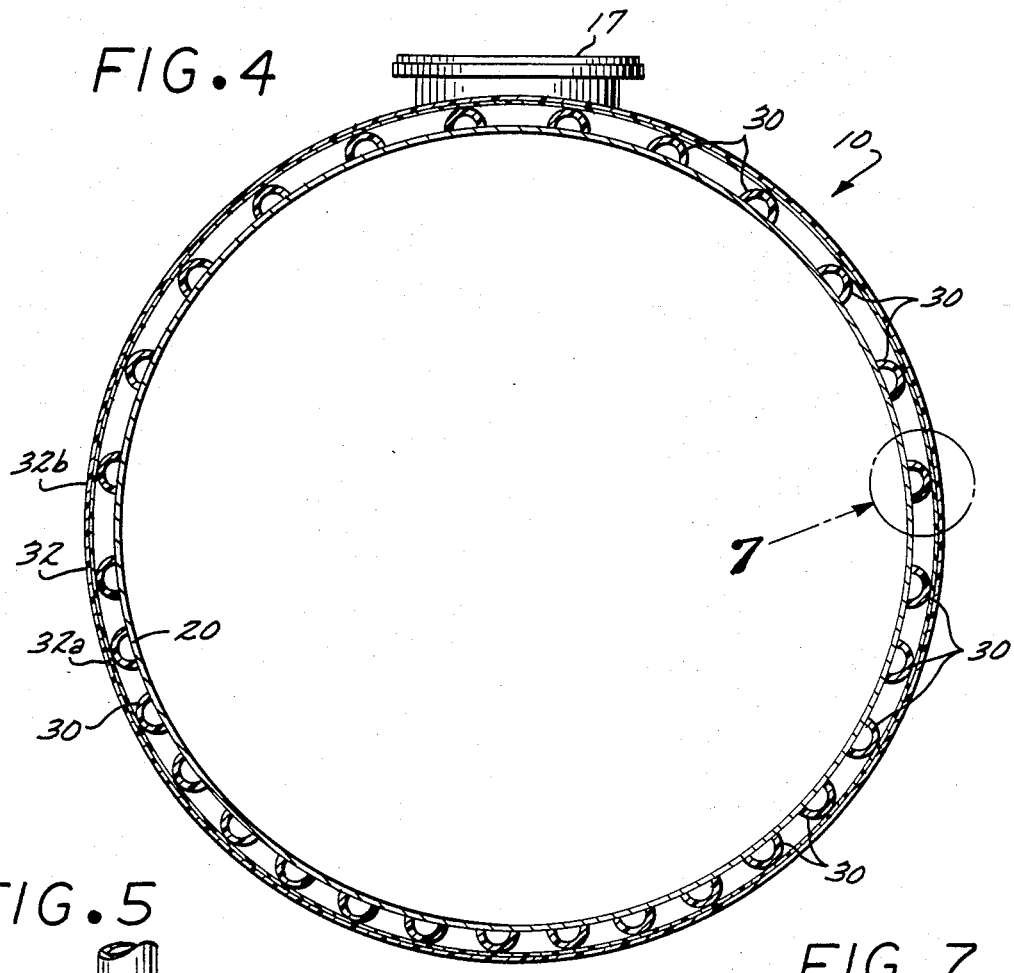
FIG. 4 is a transverse sectional view of the storage tank of FIG. 1, taken substantially aong line 4—4 of FIG. 2 of the drawings.
Figure 7:
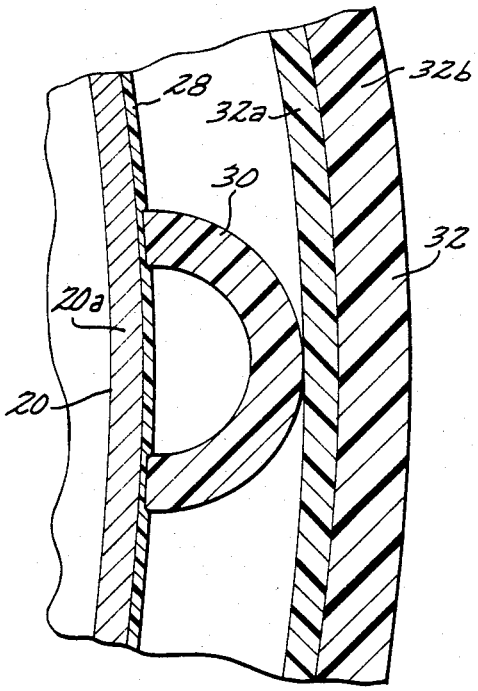
FIG. 7 is a fragmentary sectional view of area 7, as identified in FIG. 4 of the drawings.

Positioned in such coating 28, in spaced relation to each other about the arcuate exterior surface of main body 20*a*, are elongated spacers 30 which are formed of plastic material, and which, as shown in FIGS. 3, 4 and 7 of the drawings, are generally semi-circular or arcuate in cross section, as shown most clearly in these particular views of the drawings. It is contemplated that such spacers may be formed of polyvinyl chloride pipe which is very prevalent today for various plumbing requirements. Such pipe could be substantially cut in half lengthwise to provide one or two elongated semi-tubular or generally U-shaped spacers. As shown most particularly in FIG. 2 of the drawings, such spacers about the main body 20*a* of primary tank 20 extend the entire length of the tank 20, substantially parallel to the central axis of such primary tank.

As shown most particularly in FIG. 4 of the drawings, the spacers along the underside of the primary tank (the side opposite the aforementioned access fittings) are in closer spaced relation to each other than are the spacers 30 on the top side of the primary tank 20. Such arrangement is, of course, to accomodate the heavier loads beneath the tank.

In like fashion, elongated arcuate or semi-circular spacers 30*a* are provided along the endwalls 20*d* and 20*e* of tank 20. The spacers 30*a* are positioned in the resin coating on the respective sidewalls. To accomodate other components, as will hereinafter be explained, spacers 30*a* should be located in a position such that they are generally vertical when the storage tank 10 is installed in a horizontal position. The spacers 30*a* extend the width of the particular endwall and are spaced therealong as shown.

Formed about the primary tank 20 is an outer tank 32 having sheet material 32*a* formed of glass fibers embedded in plastic resin shaped about and in contact with the spacers 30 and 30*a*. Applied to such sheet material is a coating 32*b* of glass fibers embedded in plastic resin to provide a strong, but more importantly, inert exterior surface for the outer tank 32.

Figure 5:
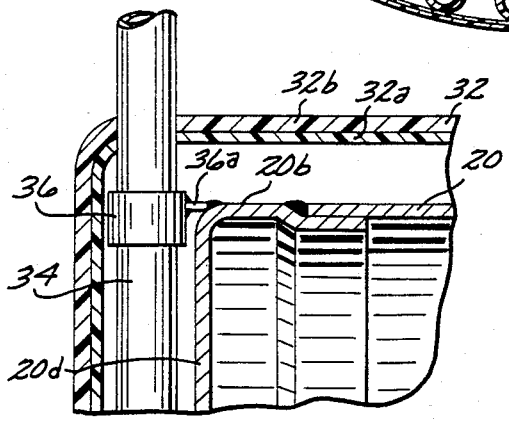
FIG. 5 is a fragmentary sectional view of area 5 of FIG. 2.
Figure 6:
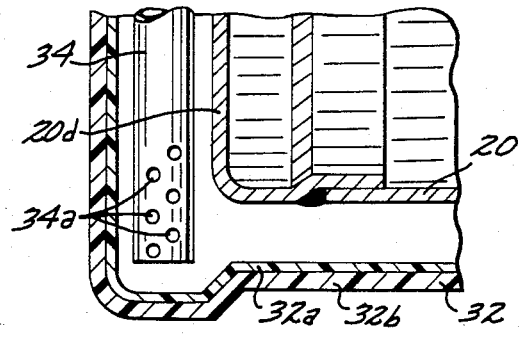
FIG. 6 is a fragmentary sectional view of area 6 of FIG. 2 of the drawings.

A probe member 34 comprising a length of plastic pipe 34*a* is positioned between each endwall of primary tank 20, and the adjacent endwall of outer tank 32. As shown in FIG. 5 of the drawings, each such probe member is fastened to a fitting 36 which carries an extension 36*a* which is welded, as shown at 38, to the corresponding endwall structure 20*b* or 20*c* of primary tank 20.

The lower end portion 34*b* of each probe member 34 is perforated to provide a series of holes 34*c* through which fluid is permitted to flow into such probe member for testing of the fluid level between the primary and outer tanks. Each of the probes 34 extends above the level of the uppermost portions of the storage tank 10 to enable suitable testing devices to be inserted into the probe members.

To enable storage tank 10 to be suitably transported and positioned, hoist members 40 are attached to the top of the primary tank 20, as by welding or the like. Such hoist members are individually formed with through openings to enable hooks and the like to be inserted therein for lifting the storage tank 10.

Although I have shown and described certain specific embodiments of my invention, I am well aware that many modifications thereof are possible. The invention, therefore, is not to be restricted except insofar as is necessitated buy the prior art and by the spirit of the appended claims.

I claim:

1. A storage tank comprising, in combination, a primary tank adapted to be filled with fluid and having a coating of resinous material thereabout, an outer tank surrounding said primary tank formed of relatively inert material, and elongated spacers between said primary and outer tanks formed of plastic material and having a generally semi-circular cross-section providing a pair of spaced mounting edges, said mounting edges of said spacers being embedded in said resinous material on said primary tank to locate and retain said spacers in proper position on said primary tank.

2. A storage tank according to claim 1 wherein said primary tank is generally cylindrical in construction, having a generally cylindrical main body and relatively flat end walls, said spacers being positioned about said main body substantially parallel to the axis of said cylindrical primary tank, and the spacers at said end walls being spaced therealong in generally parallel relation.

3. A storage tank according to claim 2 wherein at least one elongated probe member is positioned substantially parallel to one of said end walls to provide a receptacle for fluid between said primary and outer tanks.

4. A storage tank according to claim 3 wherein said outer tank is formed of sheet material comprising glass fibers embedded in resinous material.

5. A storage tank according to claim 4 wherein said probe member is positioned at substantially right angles to the spacers about the main body of said primary tank such that upon positioning of said storage tank with the axis of said primary tank in horizontal position, the probe member is in a vertical position.

6. A storage tank according to claim 5 wherein the spacers about said main body beneath said primary tank, when the probe member is substantially vertical, are in closer spaced relation than the spacers then above said primary tank.

7. A storage tank according to claim 6 wherein the outer tank is formed about the spacers positioned on the resinous material on said main body, said outer tank abutting the convex surface of said arcuate spacers.

* * * * *